US009421150B2

(12) United States Patent
Burnett

(10) Patent No.: US 9,421,150 B2
(45) Date of Patent: Aug. 23, 2016

(54) QUICK-ACCESS BOTTLE TOP FOR A BABY BOTTLE

(71) Applicant: Elizabeth M. Burnett, Gilbert, AZ (US)

(72) Inventor: Elizabeth M. Burnett, Gilbert, AZ (US)

( * ) Notice: Subject to any disclaimer, the term of this patent is extended or adjusted under 35 U.S.C. 154(b) by 76 days.

(21) Appl. No.: 14/510,002

(22) Filed: Oct. 8, 2014

(65) Prior Publication Data

US 2016/0101023 A1 Apr. 14, 2016

(51) Int. Cl.

| | |
|---|---|
| ***A61J 9/08*** | (2006.01) |
| ***A61J 9/00*** | (2006.01) |
| ***A61J 11/04*** | (2006.01) |

(52) U.S. Cl.

CPC .. *A61J 9/00* (2013.01); *A61J 9/085* (2013.01); *A61J 11/04* (2013.01)

(58) Field of Classification Search

CPC ..... A61J 9/00; A61J 11/04; A61J 11/045; A61J 11/00; A61J 11/008

USPC ..... 215/11.1–11.6, 229, 306, 6; 606/234, 606/235, 236; 604/77; 222/211; 220/253, 220/717

See application file for complete search history.

(56) References Cited

U.S. PATENT DOCUMENTS

| | | | | | |
|---|---|---|---|---|---|
| 2,838,768 | A * | 6/1958 | Fischett | A47K 1/14 | 215/306 |
| 4,448,316 | A * | 5/1984 | Hiroshige | B65D 77/283 | 215/229 |
| 4,934,556 | A * | 6/1990 | Kleissendorf | B65D 39/04 | 215/256 |
| 5,167,354 | A * | 12/1992 | Cohanfard | A45F 3/16 | 215/229 |
| 6,039,207 | A * | 3/2000 | Adamek | B65D 81/3879 | 215/303 |
| 6,110,193 | A * | 8/2000 | Chen | A61J 7/0046 | 604/77 |
| 6,547,808 | B2 | 4/2003 | Tuckey et al. | | |
| 7,124,907 | B2 | 10/2006 | Conaway | | |
| 7,931,166 | B2 | 4/2011 | Cuocolo, Jr. | | |
| 8,376,173 | B2 | 2/2013 | Britto et al. | | |
| D683,188 | S | 5/2013 | Gold et al. | | |
| 8,668,106 | B1 | 3/2014 | Joy et al. | | |
| 8,672,174 | B1 | 3/2014 | McMullin | | |
| 2001/0035430 | A1 * | 11/2001 | Litscher | A45D 34/00 | 222/94 |
| 2003/0018359 | A1 * | 1/2003 | Tuckey | A61J 7/0046 | 606/236 |
| 2005/0184026 | A1 * | 8/2005 | Haley | B65D 47/06 | 215/306 |
| 2008/0308567 | A1 * | 12/2008 | Counts-Bradley | F16L 55/115 | 220/789 |
| 2009/0101617 | A1 | 4/2009 | Viggiano | | |
| 2012/0065608 | A1 * | 3/2012 | Costello | A61J 9/00 | 604/403 |

* cited by examiner

*Primary Examiner* — Fenn Mathew
*Assistant Examiner* — Cynthia Collado
(74) *Attorney, Agent, or Firm* — Thomas W. Galvani, P.C.; Thomas W. Galvani

(57) ABSTRACT

A bottle top for use with a baby bottle includes a ring bounding a mouth of the bottle top and being severed latitudinally between upper and lower portions. The upper portion has first and second lower contact faces. The lower portion has opposing first and second upper contact faces. The top includes a nipple coupled to the upper portion which moves between an open position, in which the nipple is away from the mouth and provides access to the mouth, and a closed position, in which the first upper and lower contact faces form a sealing engagement, the second upper and lower contact faces form another sealing engagement, and the nipple is in fluid communication with the mouth.

13 Claims, 4 Drawing Sheets

QUICK-ACCESS BOTTLE TOP FOR A BABY BOTTLE

FIELD OF THE INVENTION

The present invention relates generally to drinking devices, and more particularly to bottles for feeding infants and children.

BACKGROUND OF THE INVENTION

Baby bottles are used as an alternative or supplement to breastfeeding babies and toddlers. Baby bottles are frequently filled with breast milk, formula, or even juice, water, milk, or other liquids. Typically, a caretaker will fill a predetermined amount of liquid, such as formula, into the baby bottle, and then thread a nipple onto the baby bottle. The caretaker will have decided on the predetermined amount, such as four ounces, based on a number of factors, such as the baby's size, the time of feeding, the baby's feeding habits, etc. The caretaker gives the bottle to the baby and feeds the baby until the liquid is consumed. Sometimes, a baby is still hungry after completion of a feeding, and the caretaker may wish to prepare more formula to feed to the baby. This requires that the caretaker threadably remove the nipple from the bottle, place the nipple down, mix the formula into water, add it to the bottle, and then replace the nipple. If the nipple was placed on a dirty surface, such as a floor or messy counter top, this could contaminate the newly-prepared liquid within the bottle. Further, it can be awkward to mix formula in a bottle while also dealing with a baby who is still hungry after feeding and is likely crying or flailing.

When a baby does finish feeding, the bottle and nipple must be cleaned. Generally, this requires threadably removing the nipple from the bottle and cleaning the nipple and bottle separately. Some caretakers will wash both by hand, some will wash one by hand and the other with a dishwasher, and some will wash both with the dishwasher. Regardless of the method of washing, it is important to keep the nipple and bottle together; some nipples fit only certain bottles, some nipples dispense faster or slower than others and should not be confused, and sometimes a special rack has to be used in a dishwasher to clean a nipple so that it is not lost or damaged.

Given that a caretaker's life is often already busy and hectic by the presence of an infant or toddler, an improved device allowing caretakers to better attach a nipple to a bottle, access the interior of the bottle during feeding, and clean the bottle is needed.

SUMMARY OF THE INVENTION

According to the principle of the invention, a quick-access or flip-top bottle top includes a ring and a nipple. The ring is severed between an upper portion, to which the nipple is coupled, and a lower portion, which is securable to a baby bottle. The upper portion is hinged to the lower portion, so that the upper portion can be moved from a closed position to an open position. In the closed position, the upper portion is secured on the lower portion, and the nipple is in fluid communication with an interior of the baby bottle. In the open position, the upper portion is away from the lower portion and exposes a mouth bounded by the lower portion, through which the interior of the baby bottle is accessed.

BRIEF DESCRIPTION OF THE DRAWINGS

Referring to the drawings.

DETAILED DESCRIPTION

Figure 1:
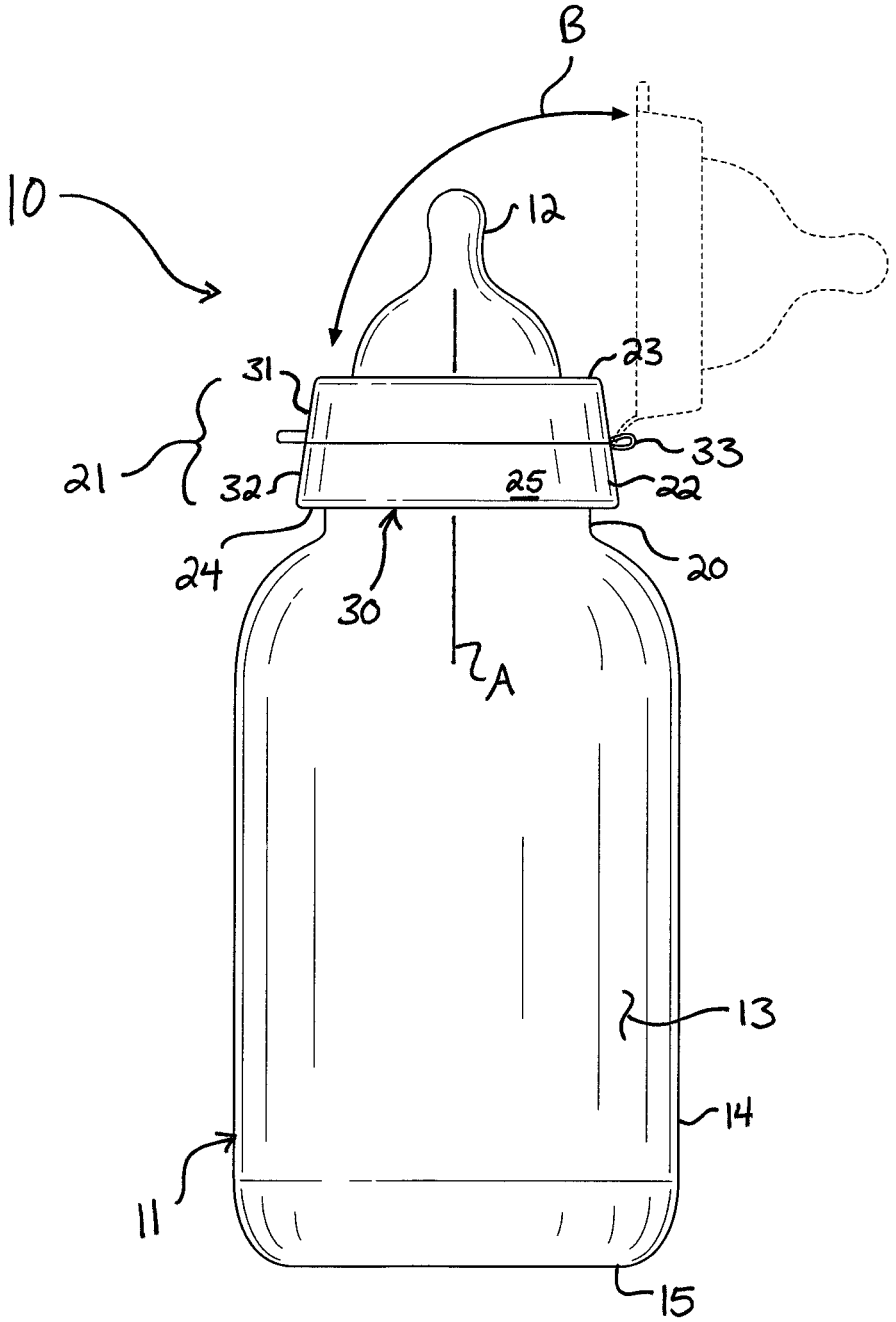
FIG. 1 is a side elevation view of a quick-access bottle top constructed and arranged according to the principle of the invention, shown as it would appear applied to a conventional baby bottle.

Reference now is made to the drawings, in which the same reference characters are used throughout the different figures to designate the same elements. FIG. 1 illustrates a quick-access bottle top 10 applied to a baby bottle 11 providing, alternately, a sealed nipple 12 through which an infant or toddler may feed from the baby bottle 11, and access to an interior 13 of the baby bottle 11 for easy pouring, mixing, cleaning, and other such activities.

The bottle top 10 is applied to a baby bottle 11 which is exemplary of conventional baby bottles useful for feeding infants and toddlers. Briefly, the term "child" will be used to describe any baby, infant, toddler, or other child who would use a bottle to drink fluids. The baby bottle 11 is conventional in that it includes a continuous sidewall 14 extending between a closed bottom 15 and an open top 20. The sidewall 14 and the bottom 15 of the baby bottle 11 bound and define the interior 14 of the baby bottle 11 for receiving, holding, and containing fluid, such as water, milk, or juice. The open top 20 is rigid and has external threads for threadably engaging a bottle top, such as the bottle top 10 illustrated in the various figures.

The bottle top 10 applies to the top 20 of the baby bottle 11. The bottle top 10 includes a rigid ring 21 which couples to the top 20 of the baby bottle 11 and the nipple 12 which is carried on the ring 21. The ring 21 is an annular, frusto-conical body defining a sidewall 22 and having a top 23, a bottom 24, an outer surface 25, and an opposed inner surface 26 (shown more clearly in FIG. 2B and various other figures). The ring 21 has a geometric axis A extending vertically and axially through the ring 21 about which the ring 21 generally has rotational symmetry. Proximate to the bottom 24 of the ring 21, the inner surface 26 closely bounds and defines a mouth 30 which is circular and open.

The ring 21 is severed latitudinally to define an upper portion 31 and an opposed lower portion 32. The term "latitudinally" as used herein means generally transverse to the geometric axis A of the ring 21. The upper and lower portions 31 and 32 are approximately equal in height along the axis A. The upper portion 31 carries the nipple 12 in sealing engagement, and the lower portion 32 is coupled to the baby bottle 11, so that that nipple 12 is, in turn, coupled to the baby bottle 11 by cooperation of the upper and lower portions 31 and 32. The upper portion 31 is mounted to the lower portion 32 at a hinge 33 for pivotal movement of the upper portion 31 between an open position and a closed position of the nipple 12 along the double-arrowed arcuate line B indicated in FIG. 1. The hinge 33 is preferably a film hinge, as shown in FIG. 1, but in other embodiments is a living hinge or some other suitable hinge for allowing tethered movement of the upper portion 31 with respect to the lower portion 32.

In the open position of the nipple 12 and the upper portion 31, the nipple 12 and the upper portion 31 are pivoted off of the lower portion 32 to expose the mouth 30 fitted onto the top 20 of the baby bottle 11, and to provide access to and through the mouth 30 and to the interior 13 of the baby bottle 11. In the closed position of the nipple 12 and the upper portion 31, the upper portion 31 overlies the lower portion 32 and sealingly engages the lower portion 32. These relative positions are discussed in detail below.

Figure 2A:
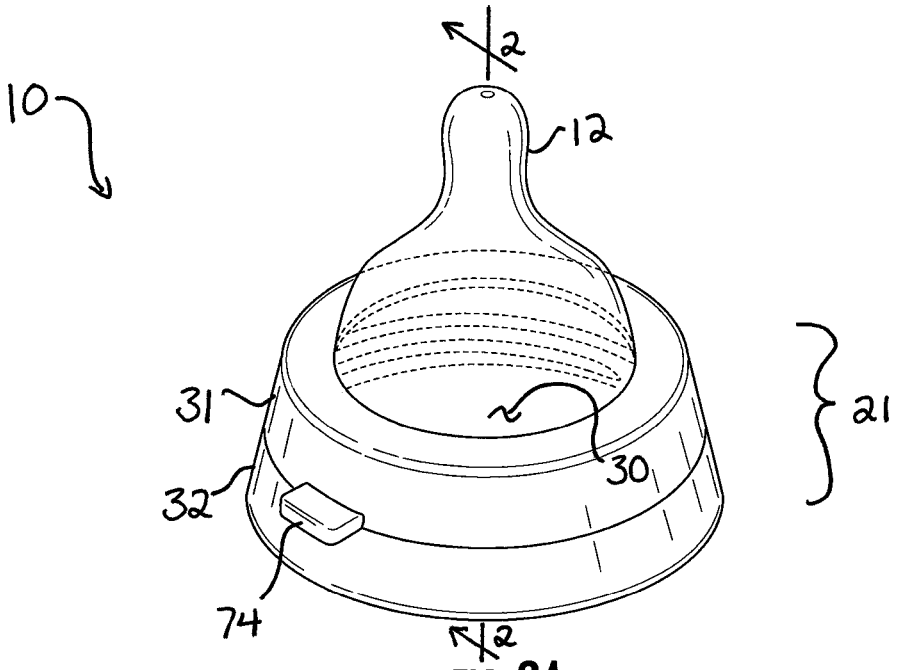
FIG. 2A is a top perspective view of the bottle top of FIG. 1 in isolation, shown in a closed position.
Figure 2B:
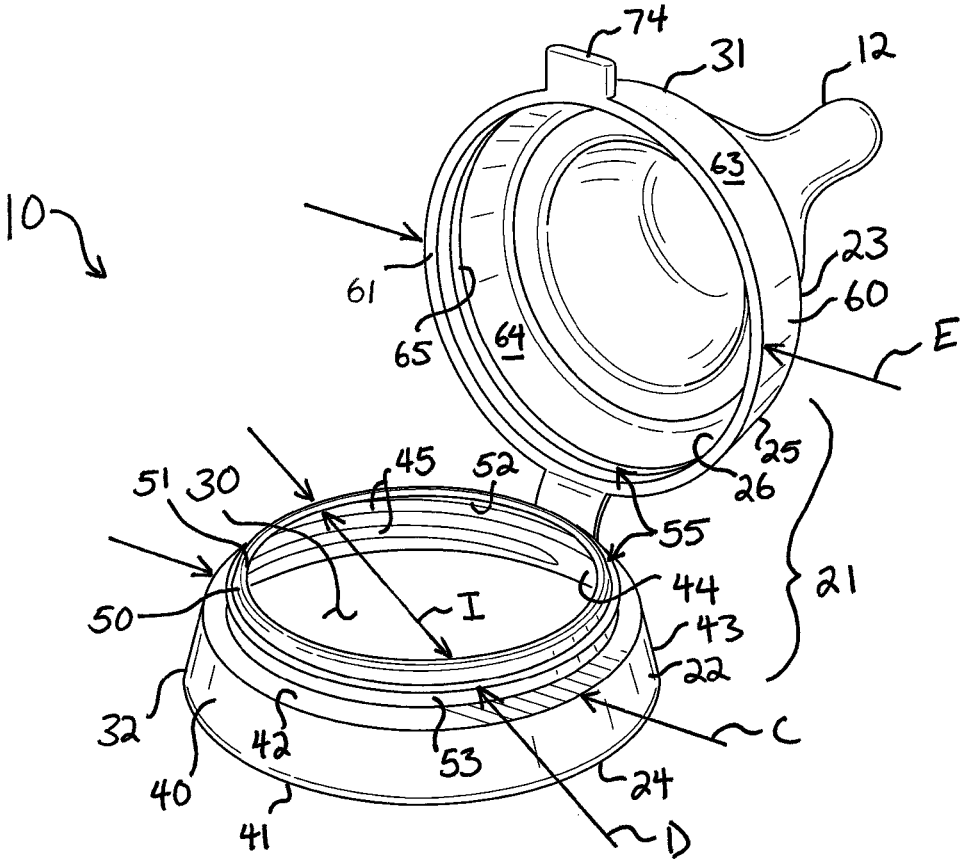
FIG. 2B is a top perspective view of the bottle top of FIG. 1 in isolation, shown in an open position.
Figure 3A:
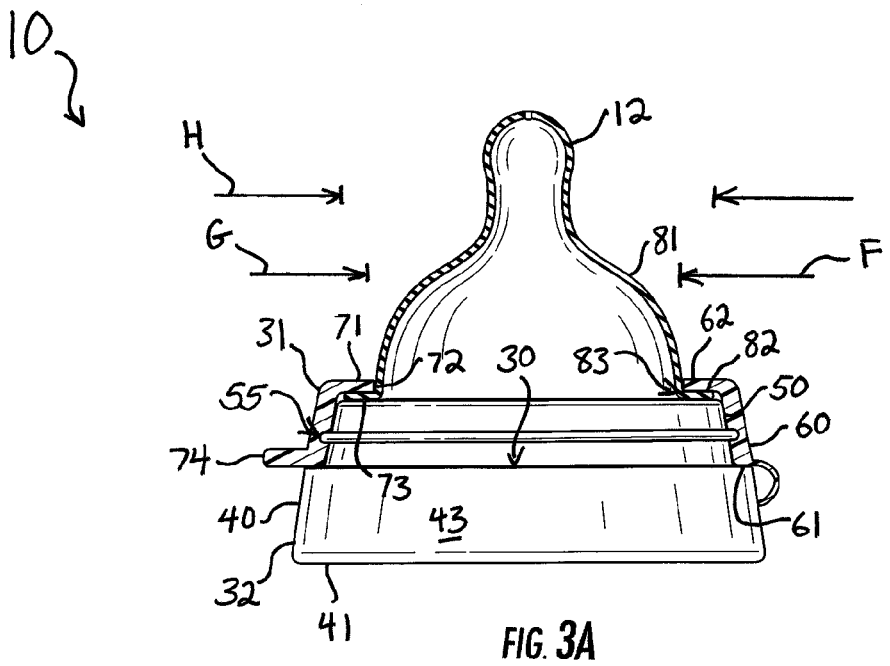
FIG. 3A is a partial side elevation and sectional view taken along the line 2-2 in FIG. 2A, showing the bottle top of FIG. 1 in the closed position.
Figure 3B:
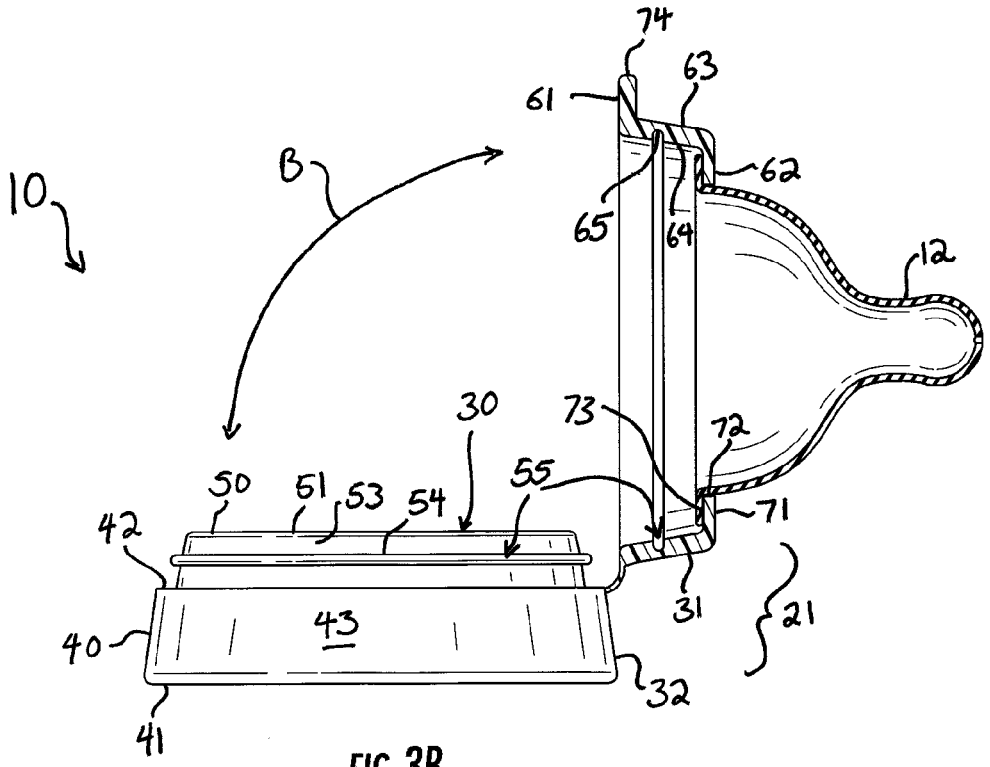
FIG. 3B is a partial side elevation and sectional view taken along the line 2-2 in FIG. 2A, showing the bottle top of FIG. 1 in the open position.

Referring now to primarily to FIG. 2B, but also to FIG. 3A and FIG. 3B, the lower portion 32 has a sidewall 40 which forms part of the body of the ring 21. The sidewall 40 has a lower surface 41, an opposed upper surface 42, an outer surface 43, and an opposed inner surface 44. The outer surface 43 is generally smooth and free of features. The inner surface 44 is provided with threads 45 for threadably engaging with the top 20 of the baby bottle 11, to create a tight, sealed fit between the baby bottle 11 and the bottle top 10. The lower surface 41 is smooth, flat, and round, enhancing the quality of the sealed fit between the baby bottle 11 and the bottle top 10. The lower surface 41 has an outer diameter C shown in FIG. 2B.

Opposed from the lower surface 41 of the lower portion 32 is the upper surface 42, which is similarly smooth, flat, and round. The upper surface 42 is annular, is formed proximate to the outer surface 43, and is coaxial and concentric to the sidewall 40. The upper surface 42 defines a contact face. An annular, coaxial, concentric boss 50 is formed on the upper surface 42 and extends upwardly from the upper surface 42 proximate to the inner surface 44 of the lower portion 32. The boss 50 is a thin upward formation and has a top surface 51, an inner surface 52 contiguous with the inner surface 44 of the lower portion 32, and an outer surface 53. The top surface 51 is smooth and flat, and has an outer diameter D, as shown in FIG. 2B. The top surface 51 is a contact face. The outer diameter D of the top surface 51 is smaller than the outer diameter C of the upper surface 42 of the lower portion 32.

The outer surface 53 is formed with a rib 54. The rib 54 is a convex, quasi-toroidal projection extending radially outward from the outer surface 53 in a generally intermediate location between the upper surface 42 of the lower portion 32 and the top surface 51 of the boss 50. The rib 50 forms an engagement element of an engagement assembly 55 carried between the upper and lower portions 31 and 32 of the bottle top 10.

Referring still primarily to FIG. 2B, but also to FIG. 3A and FIG. 3B, the upper portion 31 of the bottle top 10 has a sidewall 60 which forms a part of the body of the ring 21. The sidewall 60 has a lower surface 61, an opposed top 62, an outer surface 63, and an opposed inner surface 64. The outer surface 63 is round and generally smooth and free of features. The inner surface 64 is non-threaded and smooth but for an annular channel 65 extending into the sidewall 60 from the inner surface 64 at a location generally intermediate on the sidewall 60 between the lower surface 61 and the top 62. The channel 65 has a concave, quasi-toroidal contour sized and shaped to correspond to the rib 54 on the lower portion 32. The channel 65 receives the rib 54 therein for snappedly securing the upper portion 31 onto the lower portion 32 when the upper portion 31 is pivoted from the open position to the closed position. The rib 54, seated in the channel 65, forms a snap-fit engagement with the channel 65 that is fluid impervious such that it is characterized as a sealing engagement preventing the intrusion of liquids into and through the engagement assembly 55 and preventing the loss of liquids out of and through the engagement assembly 55.

The lower surface 61 is smooth, flat, and round. The lower surface 61 defines a contact face opposing the upper surface 42 of the lower portion 32. The lower surface has an outer diameter E, shown in FIG. 2B, which is equal in dimension to the outer diameter C of the upper surface 42 on the lower portion 32. In this way, when the upper portion 31 is snappedly received on the lower portion 31, the outer surface 63 of the upper portion 31 is smooth, flush, and contiguous with the outer surface 43 of the lower portion 32. In the closed position of the upper portion 31, the lower surface 61 of the upper portion 31 is in continuous sealing engagement with the upper surface 42 of the lower portion 32, with the lower surface 61 in continuous and unbroken annular contact with the upper surface 42. Further, the smooth and flat characteristic of the lower surface 61 enhances the quality of the sealed fit of this sealing engagement between the upper and lower portions 31 and 32.

The top 62 of the upper portion 31 is flat and extends radially inwardly from the outer surface 63 to a hole 70 having an inner diameter F, shown in FIG. 3A. The top 62 has an upper surface, an inner edge 72 bounding the hole 70, and an underside 73 opposed from the upper surface 71. The underside 73 is smooth and flat and defines a contact face opposing the top surface 51 of the boss 50, for juxtaposition with the top surface 51 of the boss 50, and which also provides a mounting surface to which the nipple 12 is secured.

A tab 74 formed on the outer surface 63 of the upper portion 31 proximate to the lower surface 61 projects radially outwardly from the upper portion 31 and provides a location by which a caretaker can open the bottle top 10. By pressing against an underside of the tab 74, or by lifting the tab 74 while holding the lower portion 32 of the ring 21 steady and stable, the upper portion 31 pivots away from the lower portion 32. The tab 74 is also useful in applying downward force on the lower portion 32 by the upper portion 31 to ensure that the upper portion 31 is secured onto the lower portion 32 when closing the upper portion 31 onto the lower portion 32.

Referring to FIGS. 3A and 3B, the nipple 12 is constructed of a flexible, elastic, compressible, resilient, and pliable material such as rubber or silicon and has a narrow tip 80 which widens to a base 81 terminating in an outwardly-flared lip 82. The base 81 has an outer diameter G, and the lip 82 has an outer diameter H, both of which are shown in FIG. 3A. The outer diameter G is equal to the inner diameter F of the inner edge 72, and the outer diameter H is greater than the inner diameter F of the inner edge 72. The lip 82 is fit under the top 62, against and in contact with the underside 73 of the top 62. The top 62 retains the nipple 12 in the upper portion 31 of the ring 21. When the upper portion 31 is in the open position thereof, the top 62 retains the nipple 12. When the upper portion 31 is in the closed position thereof, the top surface 51 of the boss 50 on the lower portion 32 presses the lip 82 of the nipple 12 into the underside 73 of the top 62 of the upper portion 31, compressing the lip 82 between the underside 73 and the top 51, so as to seal the nipple 12 against the upper portion, characterizing a sealing engagement assembly 83 formed between the upper portion 31, the lower portion 32, and the nipple 12 which prevents the intrusion of liquids into and through the sealing engagement assembly 83 and preventing the loss of liquids out of and through the sealing engagement assembly 83.

The upper portion 31 and the nipple 12 thus move between the closed position and the open position of the nipple 12 as shown in FIGS. 2A and 3A, and in FIGS. 2B and 3B, respectively. In the open position, shown in FIGS. 2B and 3B, the ring 21 is opened with the upper portion 31 pivoted away from the lower portion 32 and the mouth 30, providing access through the mouth 30. This access is wide access in that the mouth 30 has a diameter I (shown in FIG. 2B) which is substantially equal to the diameter D of the outer surface 53 of the boss 50 around the mouth 30, and which is also substantially equal to the diameter C of the upper face 42 of the sidewall 40 of the lower portion 32. Thus, the mouth 30 provides a wide access across substantially the entire width of the bottle top 10. Powders and liquids can be poured through this mouth 30 of the bottle top 10, for introduction into the interior 13 of the baby bottle 11 shown in FIG. 1, and spills are limited because of the substantial width of the mouth 30 with respect to the width of the bottle top 10. Remnant liquids are also able to poured out of the baby bottle 11 through the open mouth 30 in the open position of the upper portion 31 and nipple 12.

In the closed position of the upper portion 31 and the nipple 12, shown in FIGS. 2A and 3A, the mouth 30 is closed by the nipple 12, and the nipple 12 is in fluid communication with the mouth 30 as well as the interior 13 of the baby bottle 11 (shown in FIG. 1 only), such that fluids can flow from the interior 13, through the mouth 30, and into the nipple 12 for drinking by a child. Further, in the closed position, the sealing engagement is formed between the lower surface 61 of the upper portion 31 and the upper surface 42 of the lower portion 32.

Further, in the closed position of the upper portion 31 and the nipple 12, the rib 54 cooperates with the channel 65 to form the engagement assembly 55, which is another sealing engagement that is fluid impervious preventing the intrusion of liquids into and through the engagement assembly 55 and preventing the loss of liquids out of and through the engagement assembly 55.

Still further, in the closed position of the upper portion 31 and the nipple 12, the top surface 51 of the boss 50 on the lower portion 32 presses the lip 82 of the nipple 12 into the underside 73 of the top 62 of the upper portion 31, to seal the nipple 12 against the upper portion 31, forming the sealing engagement assembly 83 between the upper portion 31, the lower portion 32, and the nipple 12. This sealing engagement assembly 83 is formed continuously around the lip 82 and prevents intrusion of liquids into and through the sealing engagement assembly 83 and loss of liquids out of and through the sealing engagement assembly 83. In the closed position of the upper portion 31 and the nipple 12, the bottle top 10 provides a leak-proof device for a child to drink from the baby bottle 11, while a caretaker can move the upper portion 31 from the closed position to the open position to access the interior 13 when the child is not drinking from the nipple 12.

Figure 4:
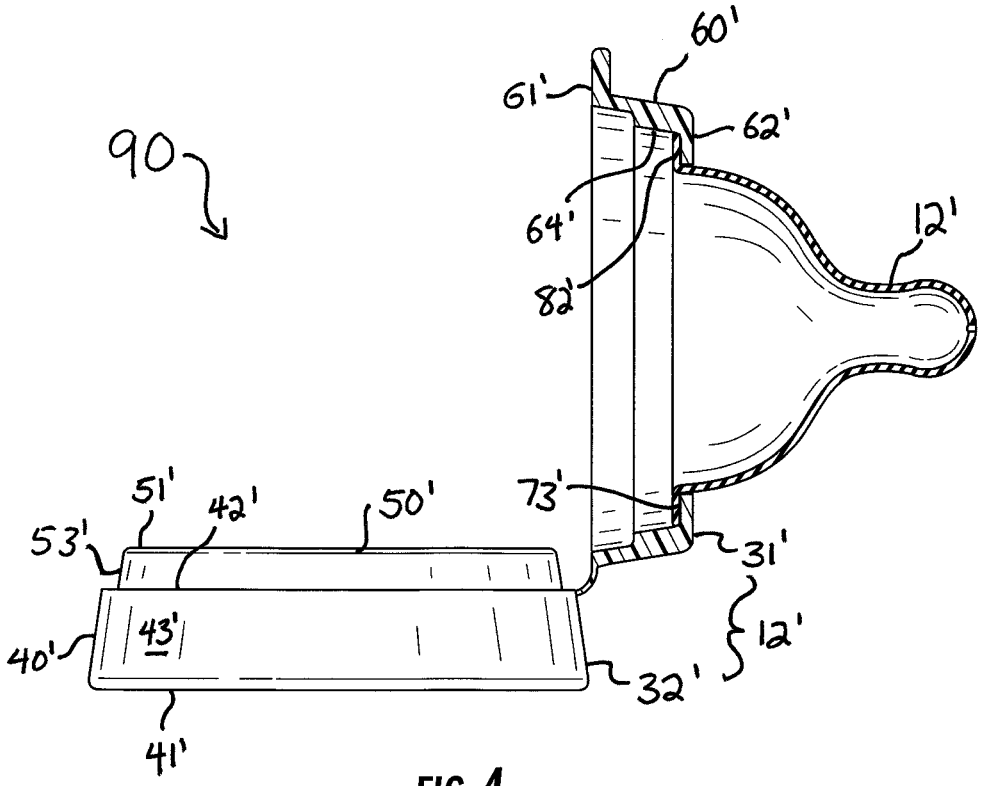
FIG. 4 is a partial side elevation and sectional view showing an alternate embodiment of a quick-access bottle top constructed and arranged according to the principle of the invention.
Figure 5:
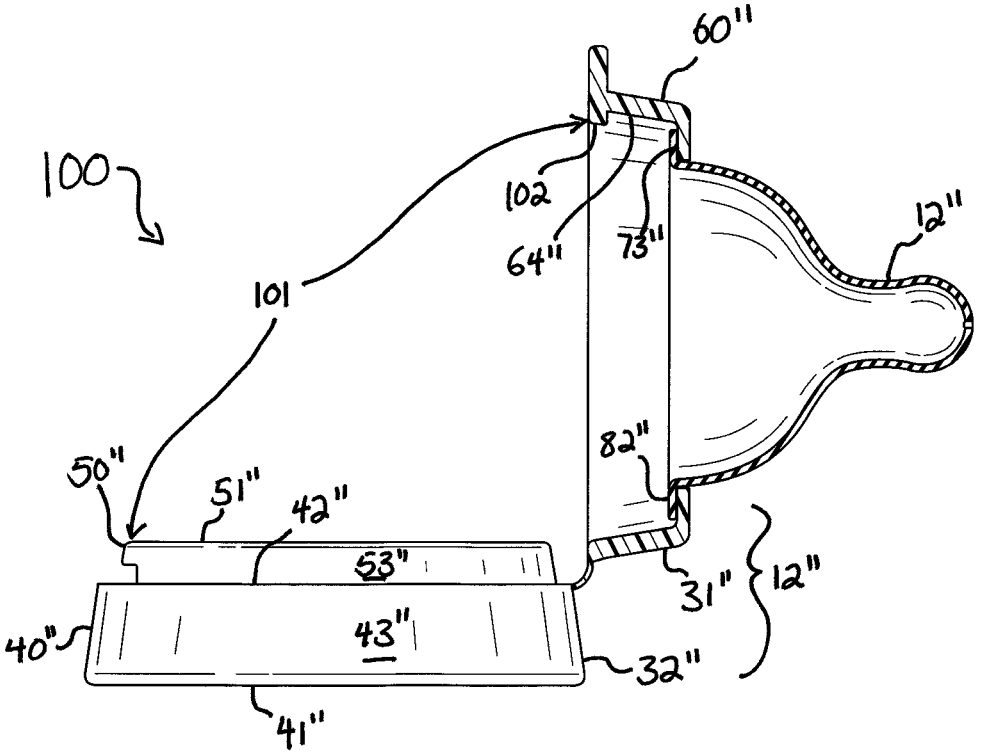
FIG. 5 is a partial side elevation and sectional view showing an alternate embodiment of a quick-access bottle top constructed and arranged according to the principle of the invention.

FIGS. 4 and 5 illustrate alternate embodiments of quick-access bottle tops for a baby bottle. FIG. 4 illustrates a quick-access bottle top 100 constructed and arranged according to the principle of the invention. The bottle top 100 is similar to the bottle top 10 and includes many identical structural features and elements. Those structural features and elements of the bottle top 100 which are identical to corresponding structural features and elements in the bottle top 10 are marked with identical reference characters, but are designated with a prime ("') symbol to distinguish them from those of the bottle top 10. FIG. 4 includes some, but not all, of the reference characters, and it should be understood that reference characters not shown are left off the figure so as to avoid crowding the figure, and not because the structural features and elements to which the reference characters correspond are not included in the bottle top 100.

As such, the bottle top 100 includes a nipple 12', ring 21', a sidewall 22', a top 23', a bottom 24', an outer surface 25', an inner surface 26', a mouth 30', an upper portion 31', a lower portion 32', a hinge 33', a sidewall 40', a lower surface 41', an upper surface 42', an outer surface 43', an inner surface 44', threads 45', a boss 50', a top surface 51', an inner surface 52', an outer surface 53', a sidewall 60', a lower surface 61', a top 62', an outer surface 63', an inner surface 64', a hole 70', an upper surface 71', an inner edge 72', an underside 73', a tip 80', a base 81', a lip 82', and a sealing engagement assembly 83'. Unlike the bottle top 10, the bottle top 100 does not include an engagement assembly formed between a rib and a channel in the lower and upper portions 31' and 32', respectively. Thus, the upper portion 31' does not have a snap-fit engagement to the lower portion 32', but instead has a press-fit engagement. When the upper portion 31' and the nipple 12' move into the closed position thereof, the outer surface 53' of the boss 50' slides into and fits tightly within the inner surface 64' of the sidewall 60' of the upper portion 31' in a press-fit engagement which is characterized as a sealing engagement in that liquid is prevented from intruding into the ring 21' and is prevented from exiting out of the ring 21'. Further, in the closed position, the top surface 51' of the boss 50' presses and compresses the lip 82' between the underside 73' and the top 51', so as to seal the nipple 12' against the upper portion 31', characterizing the sealing engagement assembly formed between the upper portion 31', the lower portion 32', and the nipple 12' which prevents the intrusion of liquids into and through said sealing engagement assembly and preventing the loss of liquids out of and through said sealing engagement assembly.

FIG. 5 illustrates a quick-access bottle top 100 constructed and arranged according to the principle of the invention. The bottle top 100 is similar to the bottle top 10 and includes many identical structural features and elements. Those structural features and elements of the bottle top 100 which are identical to corresponding structural features and elements in the bottle top 10 are marked with identical reference characters, but are designated with a double prime ("") symbol to distinguish them from those of the bottle top 10. FIG. 5 includes some, but not all, of the reference characters, and it should be understood that reference characters not shown are left off the figure to avoid crowding the figure, and not because the structural features and elements to which the reference characters correspond are not included in the bottle top 100.

As such, the bottle top 100 includes a nipple 12", ring 21", a sidewall 22", a top 23", a bottom 24", an outer surface 25", an inner surface 26", a mouth 30", an upper portion 31", a lower portion 32", a hinge 33", a sidewall 40", a lower surface 41", an upper surface 42", an outer surface 43", an inner surface 44", threads 45", a boss 50", a top surface 51", an inner surface 52", an outer surface 53", a sidewall 60", a lower surface 61", a top 62", an outer surface 63", an inner surface 64", a hole 70", an upper surface 71", an inner edge 72", an underside 73", a tip 80", a base 81", a lip 82", and a sealing engagement assembly 83". Unlike the bottle top 10, the bottle top 100 does not include an engagement assembly formed between a rib and a channel in the lower and upper portions 31" and 32", respectively. Thus, the upper portion 31" does not have a snap-fit engagement to the lower portion 32", but instead has a press-fit engagement. When the upper portion 31" and the nipple 12" move into the closed position thereof, the outer surface 53" of the boss 50" slides into and fits tightly within the inner surface 64" of the sidewall 60" of the upper portion 31" in a press-fit engagement which is characterized as a sealing engagement in that liquid is prevented from intruding into the ring 21" and is prevented from exiting out of the ring 21". Further, in the closed position, the top surface 51" of the boss 50" presses and compresses the lip 82" between the underside 73" and the top 51", so as to seal the nipple 12' against the upper portion 31", characterizing the sealing engagement assembly formed between the upper portion 31", the lower portion 32", and the nipple 12" which prevents the intrusion of liquids into and through said sealing engagement assembly and preventing the loss of liquids out of and through said sealing engagement assembly.

The upper portion 31" is held tightly onto the lower portion 32" by an interlock engagement assembly 101 formed between an inwardly-directed tab 102 formed on the inner surface 64" of the upper portion 31" and a notch 103 formed into the outer surface 53" of the boss 50". The tab 102 is disposed opposite the sidewall 60" from the tab 74' which is used to open the upper portion 31' from the lower portion 32". The notch 103 is sized and shaped to snappedly receive the tab 102 when the upper portion 31" is fit onto and over the lower portion 32". When the notch 103 is snappedly receives the tab 102, the interlock engagement assembly formed between those parts maintains the upper portion 31" and nipple 12" in the closed position of and maintains the sealing engagements.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A bottle top comprising:

a ring securable to a baby bottle, the ring closely bounding a mouth and being severed latitudinally between an upper portion and a lower portion hinged to the lower portion, the lower portion having a threaded inner surface;

a nipple pivotally mounted to move between a closed position and an open position;

in the closed position of the nipple, the mouth is closed and the nipple is in fluid communication with the mouth, a first sealing engagement is formed, and a second sealing engagement is formed separate from the first sealing engagement;

the first sealing engagement is formed by and directly between the upper portion and the lower portion;

the second sealing engagement is formed among the upper portion, the lower portion, and the nipple, and is defined by the nipple being disposed in direct contact with the upper and lower portions; and in the open position of the nipple, the nipple is away from the mouth providing access through the mouth.

2. The bottle of claim 1, wherein the nipple is coupled to the upper portion.

3. The bottle top of claim 1, wherein the upper portion has a non-threaded inner surface.

4. The bottle top of claim 1, wherein in the closed position of the nipple, the lower portion presses the nipple into the upper portion to seal the nipple against the upper portion.

5. A bottle top comprising:

a ring securable to a baby bottle, the ring including an annular sidewall having an inner surface which closely bounds a mouth of the ring;

the sidewall is severed latitudinally between an upper portion and a lower portion, and the inner surface of the sidewall along the lower portion is threaded;

a nipple is pivotally mounted to move between a closed position and an open position;

in the closed position of the nipple, the nipple is in fluid communication with the mouth, a first sealing engagement is formed, and a second sealing engagement is formed separate from the first sealing engagement;

the first sealing engagement is formed by and directly between the upper portion and the lower portion;

the second sealing engagement is formed among the upper portion, the lower portion, and the nipple, and is defined by the nipple being disposed in direct contact with the upper and lower portions; and in the open position of the nipple, the nipple is away from the mouth providing access through the mouth.

6. The bottle top of claim 5, wherein the upper portion is hinged to the lower portion.

7. The bottle top of claim 5, wherein the nipple is coupled to the upper portion.

8. The bottle top of claim 5, wherein the inner surface of the sidewall along the upper portion is non-threaded.

9. The bottle top of claim 5, wherein in the closed position of the nipple, the lower portion presses the nipple into the upper portion to seal the nipple against the upper portion.

10. A bottle top comprising:

a ring securable to a baby bottle, the ring closely bounding a mouth of the ring and being severed latitudinally between an upper portion and a lower portion, the lower portion having a threaded inner surface;

the upper portion has an annular first lower contact face and an annular second lower contact face;

the lower portion has an annular first upper contact face opposing the first lower contact face and an annular second upper contact face opposing the second lower contact face; and a nipple coupled to the upper portion moves between a closed position, in which the nipple is in fluid communication with the mouth, and an open position, in which the nipple is away from the mouth providing access to the mouth;

in the closed position of the nipple, a first sealing engagement is formed, and a second sealing engagement is formed separate from the first sealing engagement;

the first sealing engagement is formed by and directly between the upper portion and the lower portion; and the second sealing engagement is formed among the upper portion, the lower portion, and the nipple, and is defined by the nipple being disposed in direct contact with the upper and lower portions.

11. The bottle top of claim 10, wherein in the closed position of the nipple:

the first upper and first lower contact faces form said first sealing engagement; and the second upper and second lower contact face form said second sealing engagement.

12. The bottle top of claim 10, wherein the upper portion has a non-threaded inner surface.

13. The bottle top of claim 10, wherein:

the nipple has a base formed with an outwardly-flared annular lip;

the lip is fit against the first lower contact face of the upper portion; and in the closed position of the nipple, the lip is compressed between the first upper contact face and the first lower contact face.

* * * * *